US006580371B2

(12) United States Patent
Chung

(10) Patent No.: US 6,580,371 B2
(45) Date of Patent: Jun. 17, 2003

(54) CONVEYOR VEHICLE DELAY DETECTING CIRCUIT

(75) Inventor: Hsin-Hung Chung, Hsinchu (TW)

(73) Assignee: Macronix International Co., Ltd., Hsinchu (TW)

( * ) Notice: Subject to any disclaimer, the term of this patent is extended or adjusted under 35 U.S.C. 154(b) by 0 days.

(21) Appl. No.: 09/895,556

(22) Filed: Jun. 28, 2001

(65) Prior Publication Data

US 2002/0134601 A1 Sep. 26, 2002

(30) Foreign Application Priority Data

Mar. 22, 2001 (TW) ..... 90106701 A

(51) Int. Cl.[7] ..... G08B 21/00
(52) U.S. Cl. ..... 340/673; 340/676; 340/686.1
(58) Field of Search ..... 340/673, 674, 340/676, 686.1, 689.5, 691.1; 700/9, 169; 131/280, 282, 283; 73/865.8, 865.9; 198/502.1, 524; 250/328

(56) References Cited

U.S. PATENT DOCUMENTS 4,001,584 A * 1/1977 Mueller et al. ..... 250/328
4,727,353 A * 2/1988 Ruhte ..... 340/525
4,774,840 A * 10/1988 Turner ..... 73/597
4,914,964 A * 4/1990 Speiser ..... 73/865.9

* cited by examiner

*Primary Examiner*—Van Trieu
(74) *Attorney, Agent, or Firm*—J.C. Patents

(57) ABSTRACT

A conveyor vehicle delay detection circuit comprises a time counter circuit, a sensor receiver circuit, and an alarm circuit. A plurality of conveyor vehicle sensors are connected to the sensor receiver circuit and are arranged on the circuit on which the conveyor vehicles run. The flow of the conveyor vehicles is evaluated by determining whether at least one of the conveyor vehicles has passed through one of the conveyor vehicle sensors within a predetermined time interval. If within the predetermined time interval, a conveyor vehicle has not passed through at least one of the conveyor vehicle sensors, a warning signal is output to alert an operator. Immediate and adequate dispositions for reparations thus can be taken such that a normal operation of the conveyance system can quickly resume.

3 Claims, 2 Drawing Sheets

CONVEYOR VEHICLE DELAY DETECTING CIRCUIT

CROSS-REFERENCE TO RELATED APPLICATION

This application claims the priority benefit of Taiwan application serial no. 90106701, filed Mar. 22, 2001.

BACKGROUND OF THE INVENTION

1. Field of the Invention

The invention relates to a conveyance system. More particularly, the present invention relates to a circuit that detects the condition of circulation of the conveyor vehicles of a conveyance system.

2. Description of the Related Art

Conveyance system plays a substantial role in large manufactories that want to control their manufacturing time. If, for example, a conveyor vehicle that carries articles being manufactured from one processing station to another processing station inopportunely stops due to a disorder, it not only delays its time of delivery, but also the time of delivery of the other conveyor vehicles behind. As a result, the operation of each processing station through which the conveyor vehicles have to pass by to discharge the articles being manufactured is affected. The result is that the total manufacturing time of the final products and the time of delivery to the clients disadvantageously increase.

SUMMARY OF THE INVENTION

An aspect of the present invention is thus to provide a conveyor vehicle delay detecting circuit that can detect whether a conveyor vehicle has passed by predetermined locations in the conveyance passageway within a predetermined time interval. If a conveyor vehicle has not passed by one of the predetermined locations within the time interval, the present invention then activates a warning signal that alerts an operator of the delay of a conveyor vehicle. The operator thus can take immediate and adequate dispositions to recognize and repair the causes of the delay. The time interval of the disorder caused by the delay thus advantageously is reduced, which increases the efficiency of the conveyance system.

To attain the foregoing and other aspects of the present invention, a plurality of conveyor vehicle sensors are arranged at different locations of the circuit on which the conveyor vehicles circulate. A conveyor vehicle delay detection circuit connected to each of the sensors, according to a preferred embodiment of the present invention, comprises: a time counter circuit, a sensor receiver circuit, and an alarm circuit. A time interval is preset in the time counter circuit. If the time being counted by the time counter circuit exceeds the time interval preset in the time counter circuit while no vehicle has been sensed yet by one of the conveyor vehicle sensors, the time counter circuit outputs a delay signal to the alarm circuit. The alarm circuit then outputs a warning signal that activates an alarm device. The time counter circuit principally comprises a plurality of seven-segment monitors, a plurality of seven-segment latch/decode drivers, and a plurality of dual BCD up counters. The sensor receiver circuit principally comprises an operational amplifier, and the alarm circuit principally comprises a Hex buffer with high voltage open-collector outputs, a transistor, a relay device and an alarm device.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

The following detailed description of the embodiments and examples of the present invention with reference to the accompanying drawings is only illustrative and not limiting.

Figure 1:
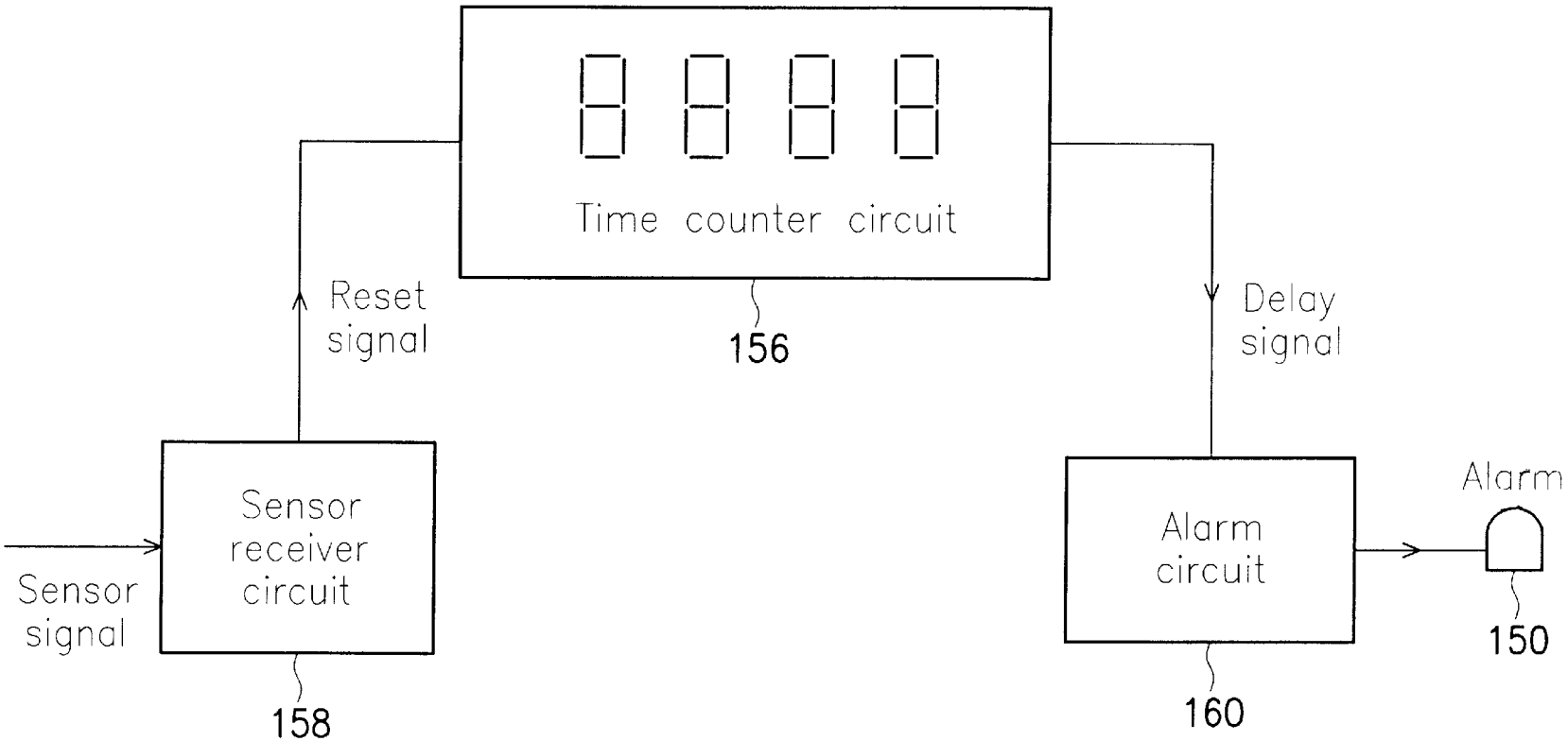
FIG. 1 is a block diagram schematically illustrating a conveyor vehicle delay detection circuit according to a preferred embodiment of the present invention.

Referring now to FIG. 1, a block diagram schematically illustrates a conveyor vehicle delay detection circuit according to a preferred embodiment of the present invention. The conveyor vehicle delay detection circuit comprises a time counter circuit 156, a sensor receiver circuit 158, and an alarm circuit 160. The conveyor vehicle delay detection circuit is connected to a plurality of conveyor vehicle sensors arranged at different locations of the circuit track (not shown) where a plurality of conveyor vehicles run. If one of the conveyor vehicles passes through one sensor, a signal is output from the sensor to the conveyor vehicle delay detection circuit. A predetermined time interval is preset for example within the time counter circuit 156. If the time counter circuit 156 counts over the preset time interval while no vehicle has passed yet through one of the sensors installed on the circuit of the conveyor vehicles, an alarm device 150 is activated to warn an operator. The alarm device 150 can be, for example, a visual alarm, a sound alarm, or any other types of alarm.

Figure 2:
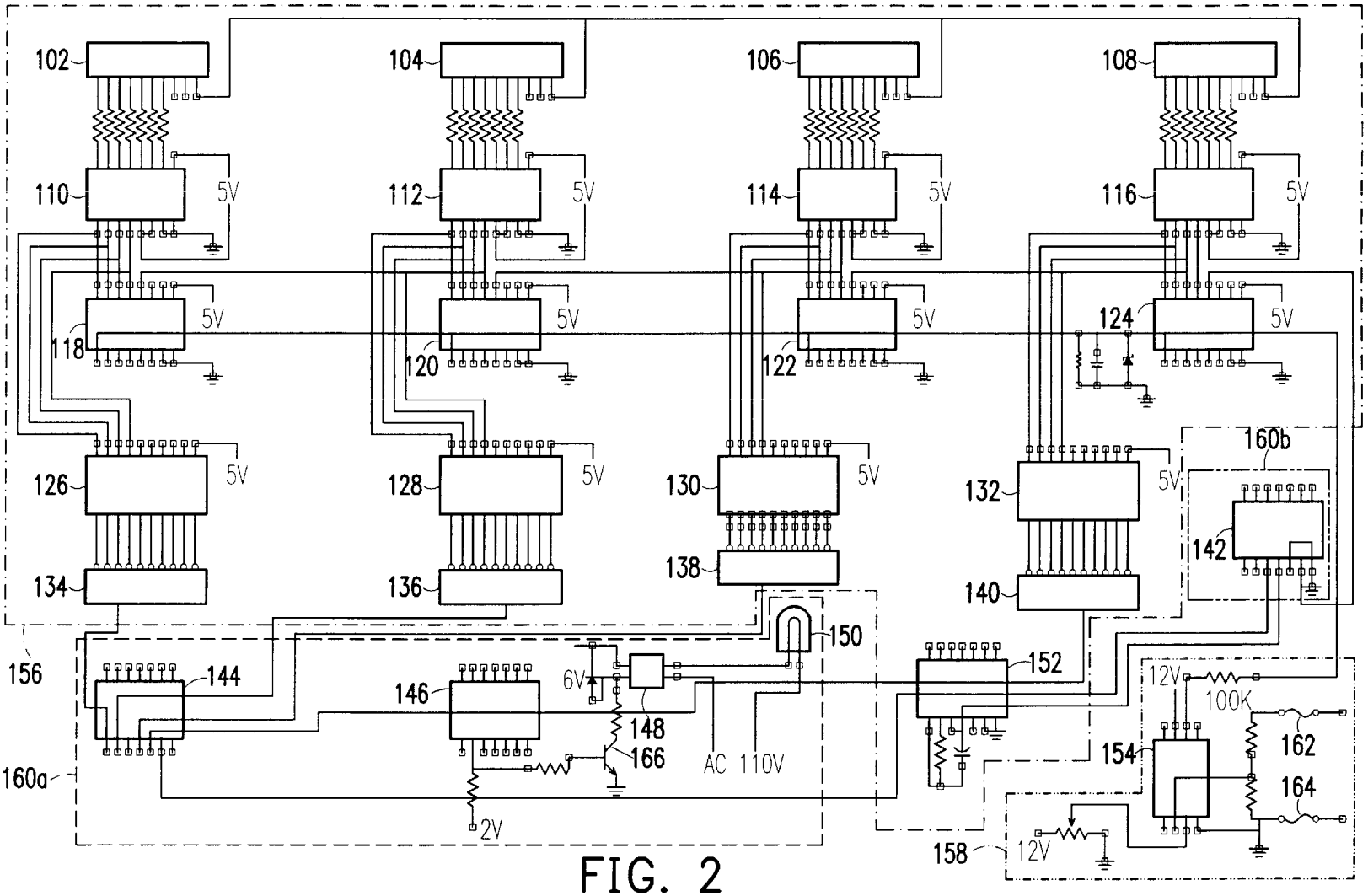
FIG. 2 is a circuit diagram of a conveyor vehicle delay detection circuit according to a preferred embodiment of the present invention.

Referring to FIG. 2, a circuit diagram schematically illustrates a conveyor vehicle delay detection circuit according to an embodiment of the present invention. The time counter circuit 156 comprises a plurality of seven-segment latch/decode drivers (110, 112, 114, 116), a plurality of dual BCD up counters (118, 120, 122, 124), a plurality of BCD decimal decoders (126, 128, 130, 132), and a plurality of seven-segment monitors (102, 104, 106, 108). In an example of implementation, the seven-segment latch/decode drivers may include a chip of No. 4511, the dual BCD up counters a chip of No. 4518, and the BCD decimal decoders a chip of No. 4028. The sensor receiver circuit 158 comprises an operational amplifier 154, for example a chip of No. uA741. The alarm circuit 160 comprises a first part 160*a* and a second part 160*b*. The first part 160*a* comprises an AND gate 144, an Hex buffer with high voltage open-collector outputs 146, a transistor 166, a relay device 148, and the alarm device 150, while the second part 160*b* principally comprises a NOR gate 142. In an example of implementation, the AND gate 144 may include, for example, a chip of No. 7421, the Hex buffer with high voltage open-collector outputs 146 may include a chip of No. 7417, and the NOR gate 142 a chip of No. 7427.

In the time counter circuit 156, a plurality of switches (134, 136, 138, 140) are used to set the desired time interval, while the seven-segment monitors (102, 104, 106, 108) show the time being counted by the time counter circuit 156. To count the time, the time counter circuit 156 comprises a time generator circuit 152. Within the sensor receiver circuit 158, the operational amplifier 154 receives a signal from the conveyor vehicle sensors.

In an example of operation, when a conveyor vehicle passes through one of the sensors, a voltage outputted from the sensor may decrease from 25V to 20V, for example. The sensor receiver circuit 158 then resets the time counter circuit 156 by outputting a reset signal to the dual BCD up counters (118, 120, 122, 124) of the time counter circuit 156. The time counter circuit 156 then restarts counting. If the time being counted by the time counter circuit 156 exceeds the preset time interval, the dual BCD decimal decoders (118, 120, 122, 124) output a delay signal which can be for example a high voltage to the AND gate 144 of the circuit part 160*a*. The AND gate 144 in turn outputs a high voltage which, through the NOR gate 142 and transistor 166, is biased to a voltage of 5V applied to the relay 148. The alarm device 150 connected to the relay device 148 then is activated to warn the operator of the occurrence of a delay. It should be apparent that the above description is only intended to illustrate a possible way of operating of the invention, and various modifications can be implemented within the scope of the invention.

In the present example of implementation, the sensor receiver circuit 158 includes, for example, two fuses 162 and 164 to protect the conveyor vehicle delay detection circuit from being damaged due to accidental excessive current. Besides, in the present embodiment of the present invention, two voltages 5V and 12V are used to ensure stability of the circuits.

The present invention, such as described in the above embodiment and examples, has at least the following advantages. With a plurality of conveyor vehicle sensors adequately installed on the circuit of the vehicles, the circulation of the conveyor vehicles thus can be monitored. If within a predetermined time interval, one of the vehicles has not passed through one of the sensors, an alarm is activated to warn an operator to take adequate dispositions for reparations. The efficiency of the conveyance system thus is improved. To determine whether the circulation is normal, a time counter circuit evaluates the flow of the conveyor vehicles. In normal operating condition, at least one of the conveyor vehicles should pass through one of the conveyor vehicle sensors within a predetermined time interval; if it is the case, the time counter circuit resets and automatically restarts counting. If within the predetermined time interval, none of the conveyor vehicles has passed through one of the conveyor vehicle sensors, a disorder has happened. The disorder can be caused by, for example, a slow down of one of the conveyor vehicles or an abnormal stop of one conveyor vehicle. An alarm then is activated. The preset time interval beyond which a delay of one of the conveyor vehicles is set in accordance with the desired flow of the conveyor vehicles and is 400 seconds in an example of implementation of the present invention.

It will be apparent to those skilled in the art that various modifications and variations can be made to the structure and operations of the present invention without departing from the scope or spirit of the invention.

What is claimed is:

1. A conveyor vehicle delay detector circuit suitable for a conveyor system including at least a conveyor vehicle sensor arranged along a circuit track, comprising:

a detection circuit, for receiving a signal from the conveyor vehicle sensor which indicates the passage of at least a conveyor vehicle through the conveyor vehicle sensor and for consequently outputting a reset signal;

a time counter setting circuit for setting a time counting value;

a time counter circuit for newly starting to count time in response to the reset signal and outputting a delay signal when the time count exceeds the set time counting value; and an alarm circuit including an Hex buffer with a high voltage open-collector output, a relay device and an alarm device.

2. The conveyor vehicle delay detector circuit according to claim 1, wherein the time counter circuit includes a seven-segment monitor, a seven-segment driver, a dual binary coded decimal up counter, a binary coded decimal-to-decimal decoder, and a timer.

3. The conveyor vehicle delay detector circuit according to claim 1, wherein the detection circuit includes an operational amplifier.

* * * * *